United States Patent [19]

Bratkowski et al.

[11] Patent Number: 5,023,583

[45] Date of Patent: Jun. 11, 1991

[54] CIRCUIT BREAKER CONTACT OPERATING STRUCTURE

[75] Inventors: Walter V. Bratkowski, McKeesport; Daun Bhasavanich, Monroeville; Norman Davies, Penn Township, Westmoreland County, all of Pa.

[73] Assignee: Westinghouse Electric Corp., Pittsburgh, Pa.

[21] Appl. No.: 260,767

[22] Filed: Oct. 21, 1988

[51] Int. Cl.[5] ..... H01H 3/00; H01H 77/00

[52] U.S. Cl. ..... 335/195; 335/16

[58] Field of Search ..... 200/147 R, 146 R; 235/16, 195

[56] References Cited

U.S. PATENT DOCUMENTS

| | | | |
|---|---|---|---|
| 4,549,153 | 10/1985 | Forsell et al. | 335/16 |
| 4,600,908 | 7/1986 | Uchida et al. | 335/16 X |
| 4,656,444 | 4/1987 | McKee et al. | 335/16 |
| 4,680,562 | 7/1987 | Bratkowski et al. | 335/16 |

*Primary Examiner*—J. R. Scott

*Attorney, Agent, or Firm*—M. J. Moran

[57] ABSTRACT

A circuit breaker contact operating structure characterized by a circuit breaker operating mechanism having separable contacts of which one is mounted on a contact carrying arm. The arm being mounted on a one leg of a U-shaped flexible conductor. A guide link is pivotally mounted and connected to the arm to maintain the contacts in alignment during their separation. The operating mechanism having a latch for latching the arm in the closed-contact position of the arm and having a trip device for unlatching the latch in response to an overcurrent condition. The mechanism link is so placed on the contact arm structure as to effect a blow-on force on the contact structure during the duration of high overcurrent. At a preset current level, the mechanism link is prevented from applying the balancing force to the contact structure, thus allowing the blow-off forces due to the current in the contact structure to separate the contacts rapidly, and to effect current limitation and subsequent circuit interruption.

5 Claims, 2 Drawing Sheets

CIRCUIT BREAKER CONTACT OPERATING STRUCTURE

CROSS-REFERENCE TO RELATED APPLICATIONS

Reference is hereby made to the following co-pending application dealing with related subject matter and assigned to the assignee of the present invention:

"Circuit Breaker With Low Voltage Contact Structure" by Walter V. Bratkowski, Daun Bhasavanich, and Norman Davies,, U.S. Ser. No. 260,766, filed Oct. 21, 1988, now U.S. Pat. No. 4,968,859.

BACKGROUND OF THE INVENTION

1. Field of the Invention

This invention relates to circuit breakers and, more particularly, it pertains to a contact operating structure with an improved adjustable withstand and current limiting of short circuit current.

2. Description of the Prior Art

Prior art low voltage, power class circuit breakers have been used with movable contact structures and operating mechanisms for providing protection for electrical circuits against electrical faults, and more particularly, electrical overload conditions, low level short circuit or fault current conditions, and, in some places, high level short circuit or fault current conditions. Such prior art devices have utilized a trip mechanism for controlling the movement of an overcurrent toggle structure for separating a pair of electrical contacts upon the occurrence of an overload condition or upon a short circuit or fault current condition. These trip mechanisms have also included a bi-metal movable in response to an overload condition to rotate a trip bar to open a pair of electrical circuit breaker contacts. Moreover, the trip devices have utilized a magnet-driven or electromagnetic-driven armature movable in response to the flow of short circuit or fault current to similarly rotate the trip bar to cause the pair of contacts to separate.

While large amounts of current and/or voltage are involved, a primary circuit breaker is provided with a plurality of secondary breakers downstream leading to specific current loads. Where a specific load generates an overcurrent condition which is handled by a particular secondary circuit breaker, the primary breaker is also involved. However, it is usually undesirable to actuate the primary breaker and thereby interrupt current through the several other secondary breakers to their respective loads. For this reason, it is desirable to delay actuation of the primary breaker and withstand the short circuit current until the secondary breaker has an opportunity to trip. The device at the present level of the fault current, the primary breaker will be tripped, its contacts parting rapidly, and fault current limitation is achieved of the present invention involves and satisfies this particular circumstance.

SUMMARY OF THE INVENTION

In accordance with this invention, a circuit breaker is provided having a contact operating structure which has an increased current withstand capability and upon contact opening; perform current limitation, and comprises a pair of separable contacts including a movable contact, a fixed contact, a movable contact arm carrying the movable contact and movable between open and closed positions of the contacts, an adjustable operable mechanism for actuating the contact arm and comprising a pivotally supported releasable member, latching means for latching, the releasable member and including a latched lever movable between latched and unlatched positions of the releasable member, trip means for releasably holding the latch lever in the latched position, a flexible member comprised of at least one strand of electrically conductive material and having a generally U-shaped configuration and including two U-legs and an arcuate bight portion having a center of curvature between the U-legs, the movable contact arm being mounted on one leg of the flexible member, the other U-leg being connected to a conductor in the electric circuit of the circuit breaker and a guide link having one end pivotally mounted substantially on the center of curvature and having another end pivotally mounted on the contact arm to keep the contacts in alignment with each other during movement of the arm. The invention also comprises a circuit breaker system having a primary circuit breaker upstream of a plurality of secondary circuit breakers leading to separate current loads respectively, the primary breaker having a delayed trip action in response to an overcurrent condition at one load in order to allow tripping of the secondary breaker involved and thereby prevent tripping of the primary breaker until the present current level is reached.

DESCRIPTION OF THE PREFERRED EMBODIMENT

Figure 1:
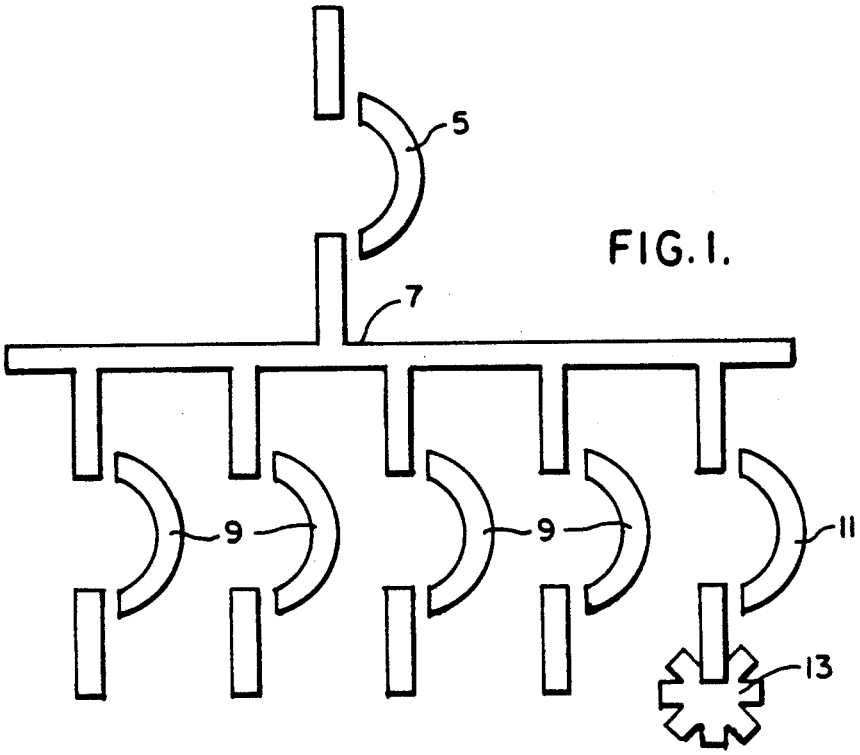
FIG. 1 is a diagrammatic view of a series rating system showing a primary breaker and a plurality of secondary breakers.

In FIG. 1 a primary or main circuit breaker 5 is electrically connected by conductors or bus bars 7 to a plurality of similar secondary or branch circuit breakers 9, 11 which service a plurality of different loads. Usually such a system is employed for handling large amounts of current and voltage. When a fault 13 occurs in the load attended by the circuit breaker 11, the breaker 11 should open before the breaker 5 in order to maintain the circuits through the circuit breakers 9.

In accordance with this invention, the circuit breaker 5 is provided with means for delaying opening of the circuit through the breaker 11 and the circuit breaker 5 withstands the fault current over the duration. For that purpose the primary breaker 5 is provided with a mechanism for presetting the lever for tripping the circuit breaker in order to cause the secondary breaker 11 to open first.

The primary or main circuit breaker 5 (FIG. 2) is mounted in a molded or insulated case 15 of insulating material which includes a base 17 that is mounted on a panel board 19. A pair of bus, bar terminals 21, 23 extend through the panel board connected to the circuit breaker.

The circuit breaker 5 includes an operating mechanism 25 that includes a pair of contacts 27, 29, the former of which is mounted on a moveable contact carrying arm 31. The contact 29 is mounted on a fixed conductor 33. In addition to the operating mechanism 25, the circuit breaker 5 includes latching means including a latch lever 35 having a releasable means including a releasable lever 37. The circuit breaker 5 also includes an electromagnetic trip device 39.

In accordance with this invention, the contact arm 31 is mounted on a flexible member 41 having a substantially U-shaped configuration and being the pivot for rotation of the contact arm between the closed position and the (broken line) open position 31*a*. The contact arm 31 is mounted on one leg of the U-shaped flexible member 41 by metallurgical bonding, such as by brazed joints 43. Similarly, the other leg of the U-shaped flexible member 41 is secured to a conductor 47 and a metallurgical bond, such as a brazed joint 49. Though the flexible member 41 may be comprised of a single strand of metal, such as copper, it is preferably comprised of a plurality of laminations which provide sufficient flexibility for movement of the arm between the open and closed positions of the contacts 27, 29.

Figure 2:
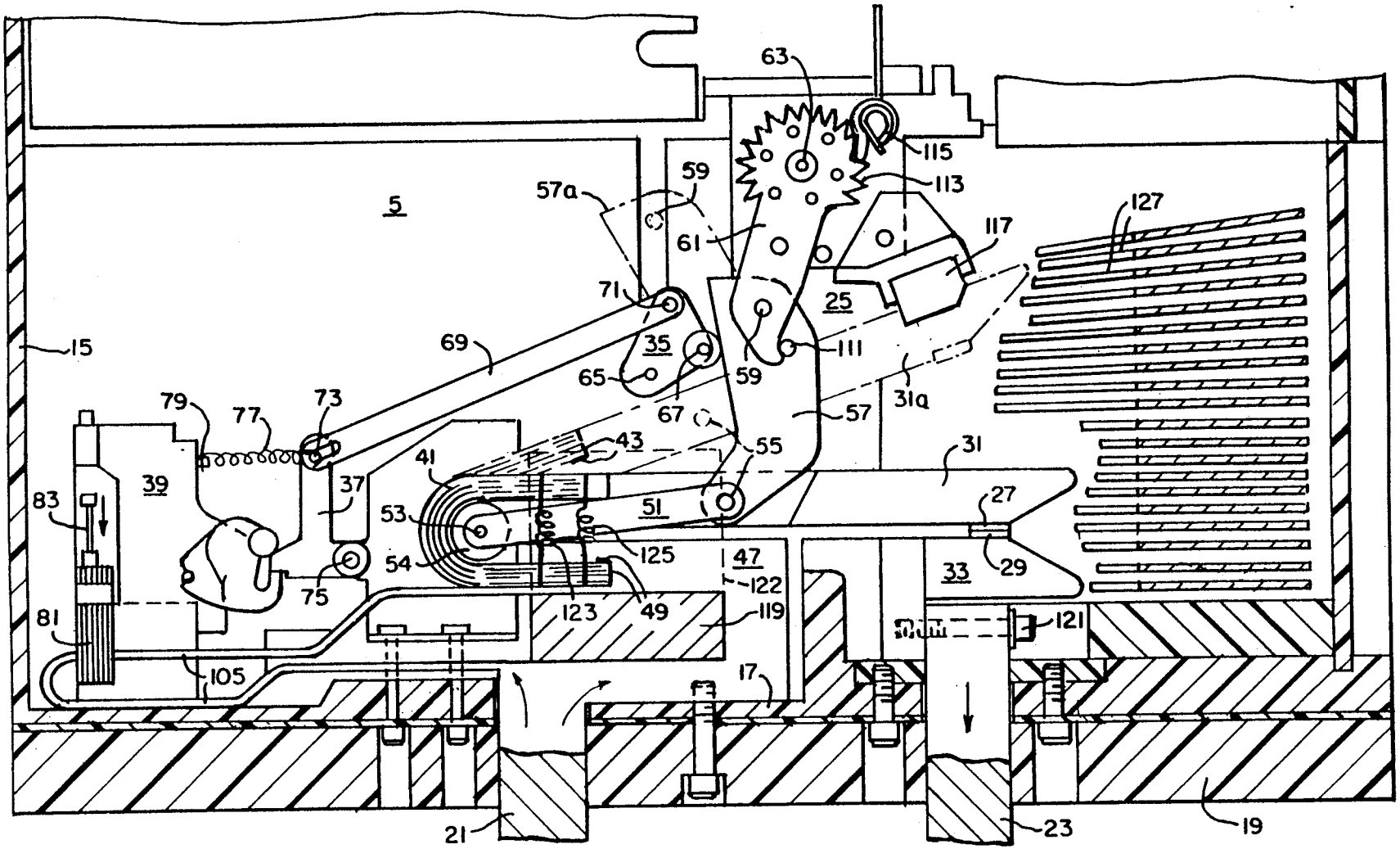
FIG. 2 is a sectional view through a circuit breaker of this invention.

In order to maintain the arm 31 in alignment during movement between open and closed positions of the contacts 27, 29, the arm comprises means for guiding the arm including a pair of guide links on opposite sides of the arm of which only one link 51 is shown (FIG. 2). The left end of the link 51 is pivoted at 53 substantially on the center of a curvature of the U-shaped flexible member 41. The member 41 bends around a dielectric spool 54 that is mounted on the pivot 53. The right end of the link 51 is pivoted at 55 on the arm 31, thereby guiding the arm between its opening and closing movements.

Movement of the arm 31 is also controlled by an actuating leg 57 which is pivotally mounted at 55 on the arm. The leg 57 provides a link between the movable contact arm 31 and the actuating mechanism of the circuit breaker. The primary purpose of the leg is to delay opening of the contacts 27, 29, in response to electromagnetic repulsion forces incurred between the arm 31 and the conductors 33, 47, as well as between the upper and lower legs of the flexible member 41. The upper end of the leg is pivoted at 59 to a lever 61 which is driven around a driven shaft 63 for closing the contacts 27, 29 by lowering the arm 31. The latch lever 35 being pivoted at 65 to a frame member (not shown) includes a pivotally mounted roller 67 which bears against the left side of the leg against the opening pressure of the repulsion forces which are explained hereinbelow.

A link 69 extends between a pivot 71 on the latch lever and a pivot 73 on the leasable lever 37 which in turn is pivoted at 75 on a portion of a frame within the circuit breaker 5. A spring 77 extends between the pivot 73 and a fixed pin 79 on the trip device 39 which is fixed in place.

Figure 3:
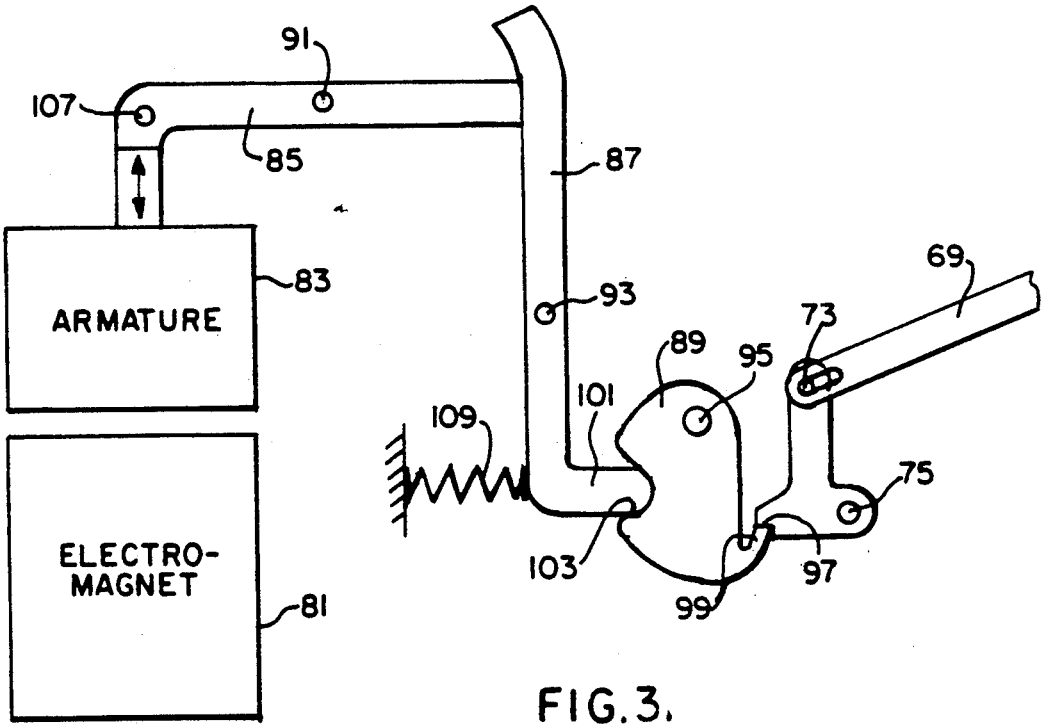
FIG. 3 is a diagrammatic view of a trip unit which may be incorporated in the circuit breaker of FIG. 2.

The trip device 39 includes an electromagnet 81 (FIGS. 2, 3), an armature 83, a lever 85, a lever 87, and a latch lever 89 (FIG. 3). The levers 85, 87, 89 are pivotally mounted respectively at pivots 91, 93, 95. The releasable lever 37 includes a latch surface 97 which engages a projection 99 on latch lever 89.

When the contacts are closed, the releasable lever 37 is retained in the position shown (FIGS. 2, 3) with the latch lever 89 retained in place by a projection 101 at the lower end of the lever 87 whose projection bears against a latch surface 103. Accordingly, when the electromagnet 81 is energized by the overcurrent flowing through a conductor 105 (FIG. 2) the armature 83 which is linked to a pivot 107 rotates the lever 85 (FIG. 3) counterclockwise to in turn rotate the lever 87 clockwise and thereby move the objection 101 away from the latch surface 103, whereby the latch lever 89 rotates clockwise away from the latch surface 97 of the latch lever 37 (FIG. 2) to ultimately open the contact 27, 29.

To reset the latch surface on the projection 99 the compression spring 77 (FIG. 2) rotates the releasable lever 37 clockwise. Simultaneously, the lever 61, which yields clockwise when the contacts open and the arm moves to the open position 31*a*, is rotated by the shaft 63 counterclockwise, causing the lever to move against a stop pin 111 on the leg 57 and returning the leg from the retracted position 57*a* where it is disposed when the arm 31 is in the open position 31*a*. In the reclosed position of the contacts the roller 67 is returned to its position against the left side of the leg 57 (FIG. 2).

The lever 61, which is fixedly mounted on the shaft 63, is provided with a ratchet 113 and a pawl 115 which operate to prevent the arm 31 from bouncing back to the closed contact position when the arm first opens and strikes a shock absorber 117.

In further accordance with this invention, the current entering the circuit breaker 5 through the terminal 21 with a larger portion entering the conductor 47 from where it enters the lower leg of the flexible member 41. Simultaneously, a smaller portion of the current is directed to the conductor 105 which extends through the coil of the electromagnet 81 and then to the lower leg of the flexible member 41.

As the current moves through the conductor 47, it is moving in a direction opposite of the current moving through the contact arm 31. Likewise, as the current continues to move through the lower leg of the flexible member 41, it moves in a direction opposite that moving through the contact arm 31. Thus, electromagnetic repulsion forces, generated between oppositely directed currents around the conductor 47 and the lower part of the flexible member on the one side, and through the arm 31 on the other side are substantial. More particularly, those forces are greater the longer the parallel current conducting paths are for members 31 and 47. The arm 31 is attached to the conductor 47 by the flexible member 41, which is preferred to having the arm 31 pivotally attached to the conductor 47 because of a longer path for repulsion is obtained. This results in increased repulsion forces between the legs of the flexible conductor.

To further increase the repulsion forces, the circuit breaker 5 may be provided with a slot motor 119 which is a laminated U-shape member having its bight portion under the conductor 47 and having upwardly extending legs, one of which legs 122 is shown, on opposite sides of the conductor 47 and the arm 31. The slot motor 119 concentrates the magnetic flux due to the flowing currents around the conductor 47 and the arm 31, thereby increasing the repulsion forces between them.

Additional repulsion force for opening or "blowing off" the arm 31 from the closed contact position is provided between the fixed conductor 33 and the right end portion (FIG. 2) of the arm 31. The current paths through the arm 31 and the conductor 33 are in opposite direction for which reason the flux currents generated around them are in opposite directions which lead to a repulsive force. As the current moves from the conductor 33, it moves to the terminal 23 to which it is attached by a screw 121.

Finally, forces for contacts located at 27 and 29 opening the contacts may be provided by employing one or more similar tension springs 123, 125 between the conductor 47 and the arm 31.

Manifestly, the forces acting upon the arm 31 for moving it to the open contact position 31*a* include repulsion forces between the left end of the arm including the upper and lower legs of the flexible member 41, the repulsion forces generated between the arm 31 and the conductor 47, repulsion forces, generated between the arm 31 and the conductor 33, and the contact forces provided by the springs 123, 125. To balance these forces and to prevent these forces from prematurely opening the contact arm 31 to the position 31*a*, the toggle assembly of the leg 57 and the lever 61 is provided to hold the arm in place with the contacts 27, 29 closed until the trip device 39 senses an overcurrent condition greater than a preset trip level in the trip device, whereby the roller 67 is moved away from contact with the leg 57.

The mechanism link leg 57 is so placed on the contact arm structure at a determined location to effect a "blow-on" force on the contact structure during the duration of high current. At a preset current level, the mechanism link leg 57 is removed whereby it can no longer apply the balancing force from leg 57, the blow-off forces due to the currents in the contact structure separate the contacts rapidly to effect current limitation and subsequent circuit interruption.

Accordingly, the primary circuit breaker 5 withstands the fault current and is delayed from opening until the fault current reaches the preset level, upon which the circuit breaker is tripped and the contacts part rapidly to effect a current limitation, and a subsequent successful circuit interruption. The withstand capability of the primary circuit breaker allows time for the secondary circuit breaker 11 (FIG. 2) to operate thereby maintaining the other secondary circuit breakers 9 in their closed positions. However, should the circuit breaker 11 fail to open the primary breaker 5 opens as a last resort.

The circuit breaker 5 also includes an arc chute or arc extinguisher 127 for extinguishing any arc occurring between the opening contacts 27, 29.

The primary low voltage power circuit breaker of this invention is novel in that when a high fault current occurs in one of the several loads downstream, the circuit breaker withstands the fault current for a sufficient time to enable operation of a secondary breaker. Otherwise, if the fault current level is so high as to exceed the preset level in circuit breaker 5, the circuit breaker will open rapidly to effect current limitation and subsequent circuit interruption.

Accordingly, the circuit breaker 5 comprises the aspects of current withstand (so called "blow-on") and current limiting (so called "blow-off"), at presettable fault current level for the overall result of the circuit breaker contact operation.

What is claimed is:

1. A circuit breaker, comprising:

a pair of separable contacts including a movable contact and a fixed contact;

a movable contact arm carrying the movable contact and movable between open and closed positions of the contacts;

an operating mechanism for actuating the movable contact arm and comprising a pivotally supported releasable member;

latching means for latching the releasable member and including a latch lever movable between latched and unlatched positions of the releasable member;

a flexible member having a generally U-shaped configuration and including two U-legs and an arcuate bight portion having a center of curvature between the U-legs;

the movable contact arm being mounted on one leg of the flexible member;

the other U-leg being connected to a first conductor in the electric circuit of the circuit breaker;

a guide link having one end pivotally mounted substantially on the center of curvature and having another end pivotally mounted on the contact arm to keep the contacts in alignment with each other during movement of the arm;

the first conductor extending substantially parallel to the movable contact arm so as to cause an induced electromagnetic repulsion force between the first conductor and the arm; and a second conductor supporting the fixed contact and extending substantially parallel to the movable contact arm when the contacts are closed and connected to a first terminal so as to cause an induced repulsion force between the second conductor and the portion of the arm adjacent to the movable contact.

2. The circuit breaker of claim 1 in which the flexible number is comprised of at least one strand of electrically conductive material.

3. The circuit breaker of claim 1 in which the flexible member is comprised of a plurality of strands.

4. The circuit breaker of claim 1 in which the flexible member includes laminations.

5. A circuit breaker, comprising:

a pair of separable contacts including a movable contact and a fixed contact;

a movable contact arm carrying the movable contact and movable between open and closed positions of the contacts;

an operating mechanism for actuating the movable contact;

a first conductor in the electrical circuit of the circuit breaker, the movable contact arm being connected to said first conductor, said first conductor extending substantially parallel to said movable contact arm so as to cause an induced electromagnetic repulsion force between said first conductor and said movable contact arm when electrical current of a predetermined magnitude is flowing in each; and a second conductor supporting said fixed contact and extending substantially parallel to said movable contact arm when said contacts are closed so as to cause an induced repulsion force between said second conductor and the portion of said arm adjacent to said movable contact when electrical current of predetermined magnitude is flowing therein.

* * * * *